US009304433B1

(12) United States Patent
Sasaki et al.

(10) Patent No.: US 9,304,433 B1
(45) Date of Patent: Apr. 5, 2016

(54) DEVELOPING DEVICE, IMAGE FORMING APPARATUS

(71) Applicant: KYOCERA Document Solutions Inc., Osaka-shi, Osaka (JP)

(72) Inventors: Yu Sasaki, Osaka (JP); Masaru Hatano, Osaka (JP); Ryo Taniguchi, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/879,767

(22) Filed: Oct. 9, 2015

(30) Foreign Application Priority Data

Oct. 14, 2014 (JP) ..... 2014-209649

(51) Int. Cl.
*G03G 15/08* (2006.01)

(52) U.S. Cl.
CPC ..... *G03G 15/0808* (2013.01)

(58) Field of Classification Search
CPC ..... G03G 15/0808
See application file for complete search history.

(56) References Cited

U.S. PATENT DOCUMENTS

| | | | | |
|---|---|---|---|---|
| 9,207,583 | B1 * | 12/2015 | Shimizu | G03G 15/0812 |
| 2004/0141770 | A1 | 7/2004 | Maeda et al. | |
| 2010/0080611 | A1 * | 4/2010 | Kurachi | G03G 15/0818 399/111 |
| 2012/0189354 | A1 * | 7/2012 | Hatano | G03G 15/0808 399/258 |
| 2014/0056603 | A1 * | 2/2014 | Abe | G03G 15/0825 399/30 |
| 2015/0293470 | A1 * | 10/2015 | Shimizu | G03G 15/0808 399/265 |

FOREIGN PATENT DOCUMENTS

JP 2004138847 A 5/2004

* cited by examiner

*Primary Examiner* — Rodney Bonnette
(74) *Attorney, Agent, or Firm* — Alleman Hall McCoy Russell & Tuttle LLP

(57) ABSTRACT

In a developing device, a developing coating layer of each of a plurality of developing rollers has been formed by a dipping method in which a developing base body is dipped in a liquid in a state where the developing base body is in a vertical attitude such that a first end of the developing base body faces down and a second end of the developing base body faces up. The plurality of developing rollers are arranged from an upstream side to a downstream side in a rotation direction of an image-carrying member in such a manner that directions faced by the first end and the second end of each of the plurality of developing rollers are alternately reversed.

6 Claims, 3 Drawing Sheets

DEVELOPING DEVICE, IMAGE FORMING APPARATUS

INCORPORATION BY REFERENCE

This application is based upon and claims the benefit of priority from the corresponding Japanese Patent Application No. 2014-209649 filed on Oct. 14, 2014, the entire contents of which are incorporated herein by reference.

BACKGROUND

The present disclosure relates to a developing device for supplying toner to an image-carrying member, and relates to an image forming apparatus including the developing device.

In general, an electrophotographic image forming apparatus includes a developing device that supplies toner to a drum-like image-carrying member such that it carries a toner image. The developing device is rotatably supported in the state of being opposed to the image-carrying member. To increase the image forming speed, it is necessary to increase the rotation speed of the image-carrying member.

Due to a restriction of a supply speed of toner from the developing roller to the image-carrying member, the density of the toner image on the image-carrying member tends to be less sufficient as the rotation speed of the image-carrying member becomes higher. There is known a developing device that, for the purpose of solving the problem of insufficient density, includes two developing rollers arranged from the upstream side to the downstream side in the rotation direction of the image-carrying member.

SUMMARY

A developing device according to an aspect of the present disclosure includes a plurality of developing rollers. The developing rollers are rotatably supported in a state of being opposed to and not contacting an image-carrying member. The developing rollers are configured to supply toner to the image-carrying member. Each of the developing rollers includes: a developing base body including a cylindrical outer circumferential surface; and a developing coating layer. The developing coating layer has been formed on the most outside of the outer circumferential surface of the developing base body. The developing coating layer has been formed by a dipping method in which the developing base body is dipped in a liquid in a state where the developing base body is in a vertical attitude such that a first end of the developing base body faces down and a second end of the developing base body faces up. The plurality of developing rollers are arranged from an upstream side to a downstream side in a rotation direction of the image-carrying member in such a manner that directions faced by the first end and the second end of each of the plurality of developing rollers are alternately reversed.

An image forming apparatus according to another aspect of the present disclosure includes: the image-carrying member configured to carry a toner image; and the developing device according to the aspect of the present disclosure.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the attached drawings. It should be noted that the following embodiments are examples of specific embodiments of the present disclosure and should not limit the technical scope of the present disclosure.

First Embodiment

Figure 1:
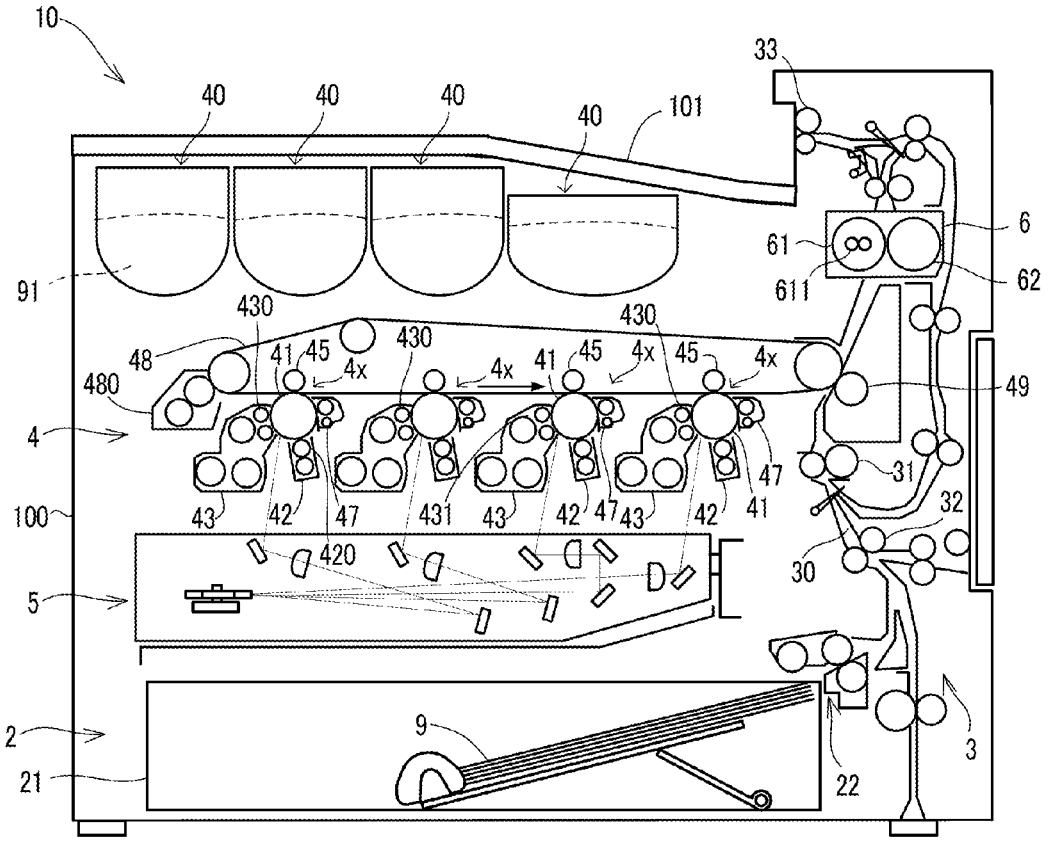
FIG. 1 is a configuration diagram of an image forming apparatus including a developing device according to the first embodiment of the present disclosure.
Figure 2:
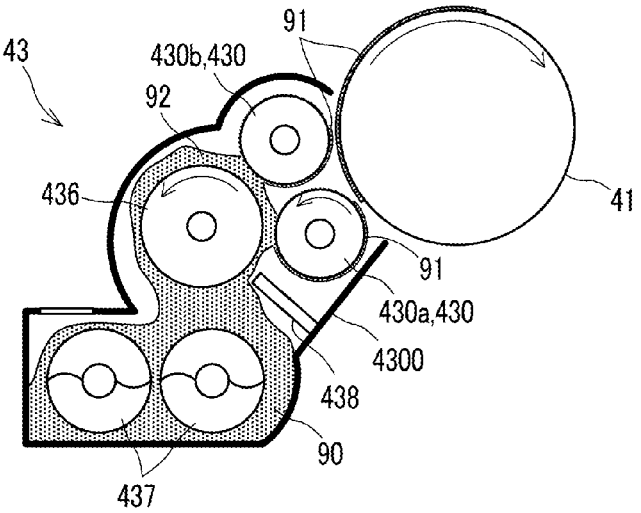
FIG. 2 is a configuration diagram of the developing device according to the first embodiment of the present disclosure.

First, a description is given of a developing device 43 according to the first embodiment of the present disclosure and an image forming apparatus 10 including the same with reference to FIGS. 1 and 2. The image forming apparatus 10 is an electrophotographic image forming apparatus. As shown in FIG. 1, the image forming apparatus 10 includes, in a housing 100, a sheet supply portion 2, a sheet conveying portion 3, toner supply portions 40, an image forming portion 4, an optical scanning portion 5, and a fixing portion 6.

The image forming apparatus 10 shown in FIG. 1 is a tandem image forming apparatus and is a color printer. As a result, the image forming portion 4 includes an intermediate transfer belt 48 and a secondary transfer device 49.

In addition, the image forming portion 4 includes a plurality of single-color image forming portions 4*x* that respectively correspond to the colors of cyan, magenta, yellow, and black. Furthermore, the image forming apparatus 10 includes a plurality of toner supply portions 40 that supply toner 91 of the colors cyan, magenta, yellow, and black respectively to a plurality of developing devices 43.

It is noted that the image forming apparatus 10 is, for example, a printer, a copier, a facsimile, or a multifunction peripheral. The multifunction peripheral has a function of the printer, a function of the copier, and the like.

The sheet supply portion 2 includes a sheet receiving portion 21 and a sheet feed portion 22. The sheet receiving portion 21 is configured to store a plurality of recording sheets 9 stacked therein. It is noted that the recording sheet 9 is a sheet-like image formation medium such as a sheet of paper, a sheet of coated paper, a postcard, an envelope, or an OHP sheet.

The sheet feed portion 22 is configured to feed a recording sheet 9 from the sheet receiving portion 21 to a conveyance path 30, by rotating while in contact with the recording sheet 9.

The sheet conveyance portion 3 includes a registration roller 31, a conveyance roller 32, and a discharge roller 33. The registration roller 31 and the conveyance roller 32 convey the recording sheet 9 supplied from the sheet supply portion 2, to the secondary transfer device 49 of the image forming portion 4. Furthermore, the discharge roller 33 discharges the recording sheet 9 after image formation, onto a discharge tray 101 from a discharge port of the conveyance path 30.

The intermediate transfer belt 48 is an endless belt-like member formed in the shape of a loop. The intermediate transfer belt 48 is rotated in the state of being suspended between two rollers. In the image forming portion 4, the single-color image forming portions 4*x* form images of respective colors on the surface of the rotating intermediate transfer belt 48. With this operation, the images of different colors are overlaid and a color image is formed on the intermediate transfer belt 48.

The secondary transfer device 49 transfers the toner image formed on the intermediate transfer belt 48 to the recording sheet 9. The secondary cleaning device 480 removes, from the intermediate transfer belt 48, toner that has remained there after the transfer by the secondary transfer device 49.

Each of the single-color image forming portions 4*x* includes a photoconductor drum 41 that carries a toner image, a charging device 42, a developing device 43, a primary transfer device 45, and a primary cleaning device 47. The photoconductor drum 41 is an example of the image-carrying member that carries a toner image while rotating.

The photoconductor drums 41 rotate at a peripheral speed (moving speed) that corresponds to a peripheral speed of the intermediate transfer belt 48. The photoconductor drum 41 may be, for example, an organic photoconductor. In addition, the photoconductor drum 41 may be an amorphous silicon photoconductor.

In each of the single-color image forming portions 4*x*, the photoconductor drum 41 rotates, and the charging device 42 uniformly charges the surface of the photoconductor drum 41. Furthermore, the optical scanning portion 5 writes an electrostatic latent image on the charged surface of the photoconductor drum 41 by scanning a laser beam thereon. The developing device 43 develops the electrostatic latent image on the photoconductor drum 41 by supplying the toner 91 to the photoconductor drum 41.

The charging device 42 includes a charging roller 420 that charges the photoconductor drum 41 before the electrostatic latent image is written thereon. The developing device 43 includes a developing tank 4300, developing rollers 430, a magnet roller 436, a stirring member 437, and a blade 438.

The developing device 43 charges the toner 91 by stirring two-component developer that includes the toner 91 and carrier 92, and supplies the charged toner 91 to the photoconductor drum 41.

The carrier 92 is a granular material having magnetism. The carrier 92 may be, for example, a granular material including magnetic body particles which are each coated with a film of synthetic resin such as epoxy resin.

The developing tank 4300 is a container for storing the two-component developer 90. The developing rollers 430, the magnet roller 436, and the stirring member 437 rotate in the developing tank 4300.

The stirring member 437 stirs the two-component developer 90 in the developing tank 4300. With this stirring, the toner 91 is charged.

The magnet roller 436 is a two-component developer carrying member that carries the stirred two-component developer 90. The magnet roller 436 supplies the toner 91 among the two-component developer 90 it carries, to the developing rollers 430.

The magnet roller 436 adsorbs and holds the carrier 92 by the magnetic force of a magnet that is embedded therein. Furthermore, a bias is applied to the magnet roller 436 such that a potential difference is generated between the magnet roller 436 and the developing rollers 430. By the action of the bias, the magnet roller 436 moves only the charged toner 91 to the developing rollers 430.

The developing rollers 430 supply the toner 91 to the electrostatic latent image on the photoconductor drum 41. This allows the electrostatic latent image to be developed as a toner image.

The developing device 43 that includes the magnet roller 436 and the developing rollers 430 develops the electrostatic latent image on the surface of the photoconductor drum 41 by the so-called interactive touchdown method.

The blade 438 restricts the thickness of the two-component developer 90 that has adhered to the surface of the magnet roller 436.

A plurality of developing rollers 430 are arranged in order from the upstream side to the downstream side in the rotation direction of the photoconductor drum 41. Each of the developing rollers 430 is rotatably supported in the state of being opposed to and not contacting the photoconductor drum 41.

To increase the image forming speed, it is necessary to increase the rotation speed of the photoconductor drum 41. When only one developing roller 430 is provided, the supply speed of the toner 91 from the developing roller 430 to the photoconductor drum 41 is restricted. This causes a tendency for the density of the toner image on the photoconductor drum 41 to be less sufficient as the rotation speed of the photoconductor drum 41 increases.

The developing device 43 includes a plurality of developing rollers 430, thus the second and onward developing rollers 430 compensate for the lack of density in the toner image. This enables the image forming speed to be increased. In the present embodiment, the developing device 43 includes two developing rollers 430.

The charging roller 420 and the developing rollers 430 are rotatably supported in a state where they face the photoconductor drum 41 from different directions.

Each of the developing rollers 430 carries the toner 91 on its outer circumferential surface and supply it to the photoconductor drum 41. The charged toner 91 flies from the developing roller 430 toward the photoconductor drum 41 by the potential difference between the developing roller 430 and the electrostatic latent image on the photoconductor drum 41.

The primary transfer devices 45 transfer the toner images on the surfaces of the photoconductor drums 41 to the intermediate transfer belt 48 that is moving while contacting the surfaces of the photoconductor drums 41. Furthermore, the primary cleaning devices 47 remove the developer that has remained on the surfaces of the photoconductor drums 41.

The secondary transfer device 49 transfers the images (toner images) transferred on the intermediate transfer belt 48 to the recording sheet 9 that is moving in the conveyance path 30.

The fixing portion 6 is a device that fixes the toner image to the recording sheet 9 by applying heat thereto. The fixing portion 6 includes a heating roller 61 and a pressure roller 62.

The heating roller 61 includes a heater 611 inside, and rotates while contacting the recording sheet 9 that is moving in the conveyance path 30 in a heated state. The heating roller 61 and the pressure roller 62 feed the recording sheet 9 with an image formed thereon to a downstream process while nipping the recording sheet 9 therebetween. This allows the fixing portion 6 to heat the toner image on the recording sheet 9 and fix the image to the recording sheet 9.

Meanwhile, in the electrophotographic image forming apparatus 10, to increase the image forming speed, it is important to improve the movement performance of the toner 91 from the developing roller 430 to the photoconductor drum 41. This also applies to the case where the developing device 43 includes a plurality of developing rollers 430.

Furthermore, to suppress the variation of image density, it is important, as one element of the movement performance of the toner 91, that the movement state of the toner 91 from the developing rollers 430 to the photoconductor drum 41 has a small variation.

As described below, the developing device 43 is configured to improve the movement performance of the toner 91 from the developing rollers 430 to the photoconductor drum 41 and achieve a high-speed image formation.

[Configuration of Developing Roller]

Figure 3:
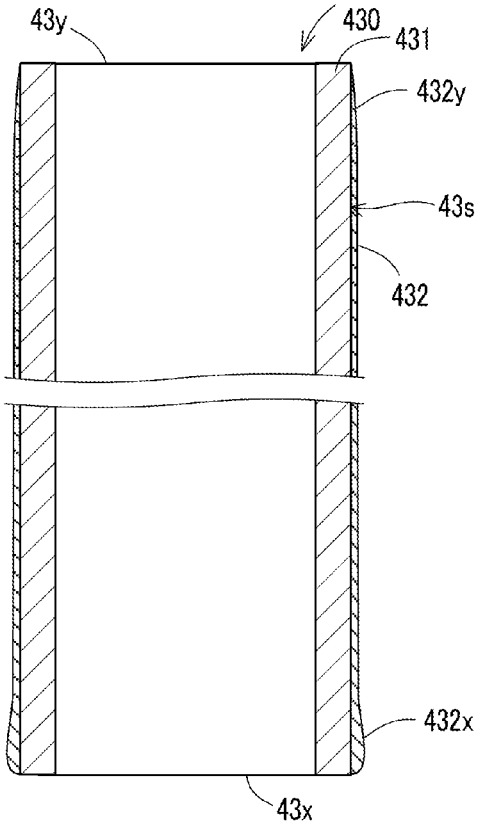
FIG. 3 is a cross-sectional view of a developing roller included in the developing device according to the first embodiment of the present disclosure.
Figure 4:
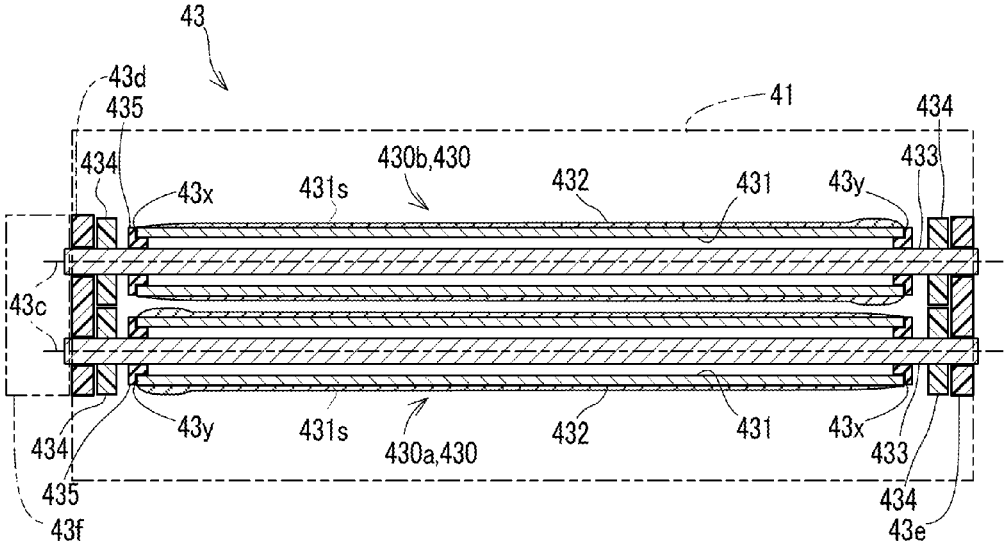
FIG. 4 is a cross-sectional view of a plurality of developing rollers supported by support portions of the developing device according to the first embodiment of the present disclosure.

Next, the configuration of the developing roller 430 is described with reference to FIGS. 3 and 4. FIG. 3 is a cross-sectional view of the developing roller 430. FIG. 4 is a cross-sectional view of the plurality of developing rollers 430 that are supported by support portions of the developing device 43.

Each of the developing rollers 430 includes a developing base body 431 and a developing coating layer 432, wherein the developing base body 431 has a cylindrical outer circumferential surface 43*s*, and the developing coating layer 432 is formed on the outer circumferential surface 43*s*. Furthermore, each of the developing rollers 430 includes a shaft portion 433 that passes through the developing base body 431 in the longitudinal direction thereof. As a result, the developing base body 431 is cylindrical.

The shaft portions 433 of the developing rollers 430 are rotatably supported by a support portion 43*d* and a support portion 43*e*. The plurality of developing rollers 430 are rotationally driven by a rotation driving portion 43*f* that is provided at an end of the developing rollers 430 in the longitudinal direction thereof. The shaft portions 433 of the developing rollers 430 are connected to the rotation driving portion 43*f*. It is noted that in FIG. 4, the photoconductor drum 41 and the rotation driving portion 43*f* are drawn by an imaginary line (two-dot chain line).

Hereinafter, a support portion that supports the developing rollers 430 on the rotation driving portion 43*f* side is referred to as a drive-side support portion 43*d*, and a support portion that supports the developing rollers 430 on the opposite side is referred to as a non-drive-side support portion 43*e*.

In the present embodiment, the developing rollers 430 are supported in a non-contact state where the outer circumferential surface of each of the developing rollers 430 is separated from the outer circumferential surface of the photoconductor drum 41 by a small distance. Furthermore, the developing rollers 430 are supported in a non-contact state where the developing rollers 430 are separated from each other.

As one example, disk-shaped spacers 434 that are respectively attached to opposite ends of the shaft portion 433 of each developing roller 430 contact the outer circumferential surface of the photoconductor drum 41 at opposite ends thereof. The spacers 434 maintain a constant distance between the photoconductor drum 41 and the developing roller 430. The spacers 434 contact the photoconductor drum 41 at opposite areas outside the image forming area.

In addition, the photoconductor drum 41 and each developing roller 430 are rotatably supported in the state where a rotation center line 41*c* of the photoconductor drum 41 and a rotation center line 43*c* of each developing roller 430 are parallel to each other.

The developing coating layer 432 is formed on the most outside of the outer circumferential surface 43*s* of the developing base body 431 by the dipping method. The developing coating layer 432 formed by the dipping method is thinner in layer thickness than formed by the spray coating method. As a result, the charge accumulation is difficult to occur on the surface layer of the developing roller 430, and the movement state of the toner 91 from the developing rollers 430 to the photoconductor drum 41 has a small variation. As a result, the variation of image density is restricted, and image quality becomes stable. It is noted that the variation of the movement state of the toner 91 is a time variation.

In addition, in the developing device 43 of the interactive touchdown developing system that includes the magnet roller 436 and the developing roller(s) 430, the developing roller(s) 430 is disposed closer to the photoconductor drum 41 than in the general developing device of the two-component developing system. In the developing device 43 as such, it is suitable to adopt, as the coating method for forming the developing coating layer 432, the dipping method that enables a thin coating layer to be formed.

In the dipping process for forming the developing coating layer 432, the developing base body 431 is dipped in a liquid that includes the material of the developing coating layer 432, in a state where the developing base body 431 is in a vertical attitude such that a first end 43*x* of the developing base body 431 faces down and a second end 43*y*, which is opposite to the first end 43*x* in the longitudinal direction of the photoconductor drum 41, faces up.

FIG. 3 is a partially omitted cross-sectional view of the developing roller 430 on which the developing coating layer 432 has been formed by the dipping method. In the dipping process, when the developing base body 431 is dipped in the liquid while it is in the vertical attitude, a part of the developing coating layer 432 on the first end 43*x* side tends to be larger in thickness than a part on the second end 43*y* side in the longitudinal direction of the photoconductor drum 41.

The above-described thickness distribution tendency of the developing coating layer 432 is prominently observed in a part 432*x* on the first end 43*x* side and a part 432*y* on the second end 43*y* side on the developing base body 431. Such a thickness distribution tendency of the developing coating layer 432 is common to coating layers that are formed by the dipping method on the surfaces of the members having cylindrical outer circumferential surfaces.

The developing base body 431 of the developing roller 430 is a cylindrical member that is made of, for example, a metal whose main component is aluminum. The developing coating layer 432 of the developing roller 430 is a coating layer formed on the most outside of the outer circumferential surface 43*s*. The developing coating layer 432 includes, for example, a layer of alcohol-soluble nylon and conductive powder that is distributed in the layer of alcohol-soluble nylon. In this case, the conductive powder may be titanium oxide powder.

In the developing roller 430, opposite ends of the developing base body 431 are fixed to the shaft portion 433 by fixing members 435.

When the developing base body 431 is made of a metal whose main component is aluminum, the outer circumferential surface 43*s* of the developing base body 431 may be an alumite layer formed by an oxidization treatment of alumimum. In that case, the developing coating layer 432 is formed directly above the alumite layer. This generates the so-called anchor effect and makes it difficult for the developing coating layer 432 to be removed from the developing base body 431.

The following describes a specific example of the method of forming the developing coating layer 432. First, a process is performed to form an oxidized film on the surface of the developing base body 431 before the formation of the developing coating layer 432.

As one example, an alumite treatment is performed to form an alumite layer on the outer circumferential surface 43*s* of the developing base body 431 that is made of a metal whose main component is aluminum. In this alumite treatment, the alumite layer that is approximately 10 micrometer thick is formed on the outer circumferential surface 43*s* of the developing base body 431.

Furthermore, a heat treatment process is performed on the alumite layer that is the oxidized film formed on the developing base body 431. In the heat treatment process, heating to a predetermined constant temperature is continued for a predetermined time period. This makes it possible to form cracks in a uniformed manner over the whole area of the alumite layer of the developing base body 431. As one example, in the heat treatment process for the alumite layer, the alumite layer is heated to a temperature of approximately 120° C. for a time period of more than 10 minutes.

The heat treatment process for the alumite layer is performed for the purpose of causing cracks to be formed on the alumite layer in advance before the dipping process for forming the developing coating layer 432 is performed. This prevents cracks from being newly formed on the alumite layer of the developing base body 431 during the drying process of the developing coating layer 432 that is executed later.

Furthermore, the dipping process is performed on the outer circumferential surface 43*s* of the developing base body 431 on which the alumite layer has been formed, so that a conductive resin coating layer is formed thereon. As one example, in this dipping process, the developing base body 431 is, in the above-mentioned vertical attitude, dipped in a mixed liquid that includes binding resin and conductive powder.

As one example, the binding resin may be alcohol-soluble nylon and the conductive powder may be titanium oxide powder. In addition, the dispersion medium of the mixed liquid may be 800 pts·wt. methanol. In that case, the mixed liquid is obtained by mixing the nylon, the titanium oxide and the 800 pts·wt. methanol with, for example, 1.0 mm diameter zirconia beads.

Finally, a drying process is performed to dry the conductive resin coating layer that has been formed on the developing base body 431 in the dipping process. As one example, in the drying process, the conductive resin coating layer is dried for approximately 10 minutes in an environment of approximately 130° C. In this process, the developing coating layer 432 with a thickness of approximately 2-11 micrometers is obtained. The duration of the drying process may be shorter than the duration of the heat treatment process.

Meanwhile, when cracks are formed on the alumite layer during the drying process, the conductive powder is likely to be distributed unevenly in the resin coating layer by the influence of the convection.

As described above, however, when cracks are formed on the alumite layer in advance during the heat treatment process, it is possible to prevent cracks from being newly formed on the alumite layer during the drying process. As a result, during the drying process, the conductive powder is evenly distributed in the resin coating layer. This makes it possible to form the developing coating layer 432 as a homogeneous layer.

The plurality of developing rollers 430 are arranged from the upstream side to the downstream side in the rotation direction of the photoconductor drum 41 in such a manner that the directions faced by the first end 43*x* and the second end 43*y* are alternately reversed. As a result, the plurality of developing rollers 430 include: first developing rollers 430*a* that are connected to the rotation driving portion 43*f* on the first end 43*x* side; and second developing rollers 430*b* that are connected to the rotation driving portion 43*f* on the second end 43*y* side.

When the developing device 43 includes an even number of developing rollers 430, the first developing rollers 430*a* and the second developing rollers 430*b* are the same in number. On the other hand, when the developing device 43 includes an odd number of developing rollers 430, either the first developing rollers 430*a* or the second developing rollers 430*b* are one more than the other.

In the developing rollers 430, the developing coating layer 432 releases the toner 91 more easily than the outer circumferential surface 43*s* of the developing base body 431. As a result, the developing rollers 430 are higher in releasability of the toner 91 and in the movement performance of the toner 91 from the developing rollers 430 to the photoconductor drum 41, than conventional developing rollers that do not include the developing coating layer 432. As a result, the adoption of the developing rollers 430 makes it possible to increase the image forming speed.

On the other hand, the above-described thickness distribution of the developing coating layer 432 may be a cause of a variation, in the longitudinal direction of the developing rollers 430, of the movement state of the toner 91 from the developing rollers 430 to the photoconductor drum 41. The variation of the movement state of the toner 91 may be the cause of the variation of the developing density.

More specifically, on the first end 43*x* side of the developing rollers 430 where the developing coating layer 432 is thick, the distance from the surface of the magnet roller 436 is small and the electric field is strong. As a result, the layer of the toner 91 on the surface of the developing rollers 430 tends to be thick. Furthermore, on the first end 43*x* side of the developing rollers 430, the distance from the surface of the photoconductor drum 41 is small, and the substantial developing bias is large.

On the other hand, on the second end 43*y* side of the developing rollers 430 where the developing coating layer 432 is thin, the distance from the surface of the magnet roller 436 is large and the electric field is weak. As a result, the layer of the toner 91 on the surface of the developing rollers 430 tends to be thin. Furthermore, on the second end 43*y* side of the developing rollers 430, the distance from the surface of the photoconductor drum 41 is large, and the substantial developing bias is small.

As a result, in areas on the first end 43*x* side of the developing rollers 430, the developed electrostatic latent image on the photoconductor drum 41 is likely to be darker than normal. On the other hand, in areas on the second end 43*y* side of the developing rollers 430, the developed electrostatic latent image on the photoconductor drum 41 is likely to be thinner than normal.

In addition, when the plurality of developing rollers 430 are arranged in such a manner that the first ends 43*x* thereof face the same direction, the variation of developing density is more prominent.

In the developing device 43, however, the plurality of developing rollers 430 are arranged in such a manner that the first developing rollers 430*a* and the second developing rollers 430*b* are reversely arranged with respect to the thickness distribution tendency of the developing coating layer 432. In this case, the thickness distribution of the first developing rollers 430*a* and the thickness distribution of the second developing rollers 430*b* cancel each other. As a result, the variation of the developing density caused by the thickness distribution of the developing coating layer 432 is restricted, and the image quality is stabilized.

In particular, when the developing device 43 includes an even number of developing rollers 430, the first developing rollers 430*a* and the second developing rollers 430*b* are the same in number, and thus the variation of the developing density can be effectively restricted.

Figure 5:
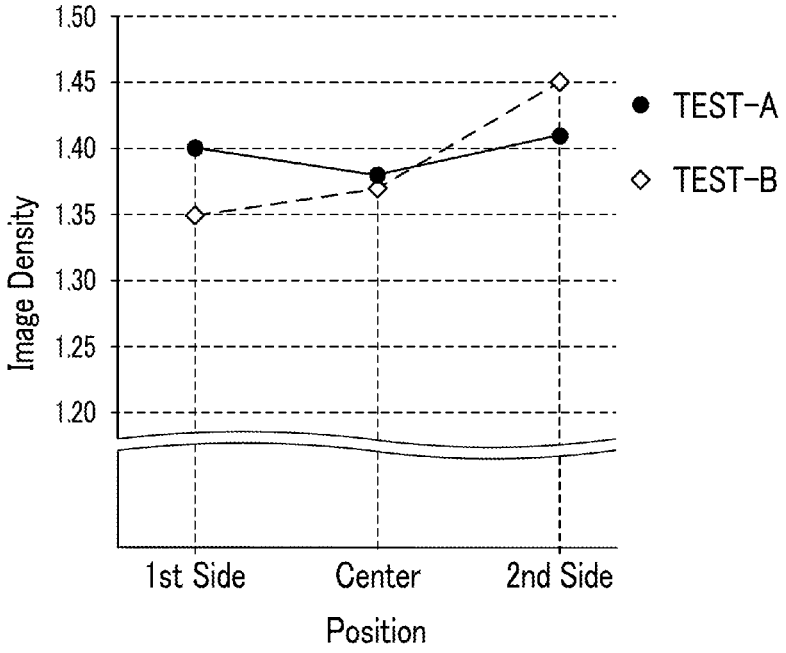
FIG. 5 is a graph showing results of a test on the image density distribution conducted on the developing device according to the first embodiment of the present disclosure and another developing device.

FIG. 5 is a graph showing results of a test regarding the image density distribution conducted on the developing device 43 that includes two developing rollers 430 an on another developing device. In FIG. 5, the graph of TEST-A shows the test results of the image forming apparatus 10.

That is, the graph of TEST-A shows the results of the test conducted for the case where the two developing rollers 430 were arranged in such a manner that the first end 43*x* of one of the two developing rollers 430 faced a direction opposite to a direction faced by the other of the two developing rollers 430. On the other hand, the graph of TEST-B shows the results of the test conducted for the case where the two developing rollers 430 were arranged in such a manner that the first ends 43*x* thereof faced the same direction.

In both TEST-A and TEST-B, the developing coating layer 432 included a layer of alcohol-soluble nylon and titanium oxide powder distributed in the layer. The conditions for TEST-A and TEST-B were the same, except for the facing direction of the two developing rollers 430. In addition, the photoconductor drum 41 was an amorphous silicon photoconductor.

In the graph of FIG. 5, the vertical axis represents the image density, and the horizontal axis represents positions in the longitudinal direction of the photoconductor drum 41, namely positions in the main scanning direction. The image density was detected for comparison at three positions in the longitudinal direction of the photoconductor drum 41: a position close to the first end; a center position; and a position close to the second end. In addition, the image density in the vertical axis represents a ratio of a density to a predetermined reference density.

As shown in FIG. 5, when the plurality of developing rollers 430 are arranged in such a manner that the directions faced by the first end 43*x* and the second end 43*y* are alternately reversed, the variation of the image density is restricted compared to a case where the plurality of developing rollers 430 are arranged in such a manner that the first ends 43*x* or the second ends 43*y* of all of the plurality of developing rollers 430 face the same direction.

When the developing device 43 includes an odd number of three or more developing rollers 430, the thickness distribution of the developing coating layer 432 of one developing roller 430 is not cancelled. However, when three or more developing rollers 430 are present, the influence, on the developing density, of the thickness distribution of the developing coating layer 432 of the one developing roller 430 is very small.

As a result, with the adoption of the developing device 43, the movement performance of the toner 91 from the developing rollers 430 to the photoconductor drum 41 is improved, and images can be formed at a higher speed.

In addition, when two adjacent developing rollers 430 are arranged in such a manner that the first ends 43*x* thereof face the same direction, the gap between the developing rollers 430 becomes uneven in the longitudinal direction of the developing rollers 430. As a result, an air flow is easily generated along the longitudinal direction of the developing rollers 430. This may cause the toner 91 to fly.

Furthermore, the rotation of the developing rollers 430 allows heat to be generated and accumulated in a portion where the gap between the two adjacent developing rollers 430 is narrow, and the portion is likely to become high temperature. Such a temperature distribution of the developing rollers 430 adversely affects the image quality.

On the other hand, in the developing device 43, an even gap is formed between an adjacent pair of the first developing roller 430*a* and the second developing roller 430*b*, and thus the flying of the toner 91 and the temperature distribution are difficult to occur.

Second Embodiment

Figure 6:
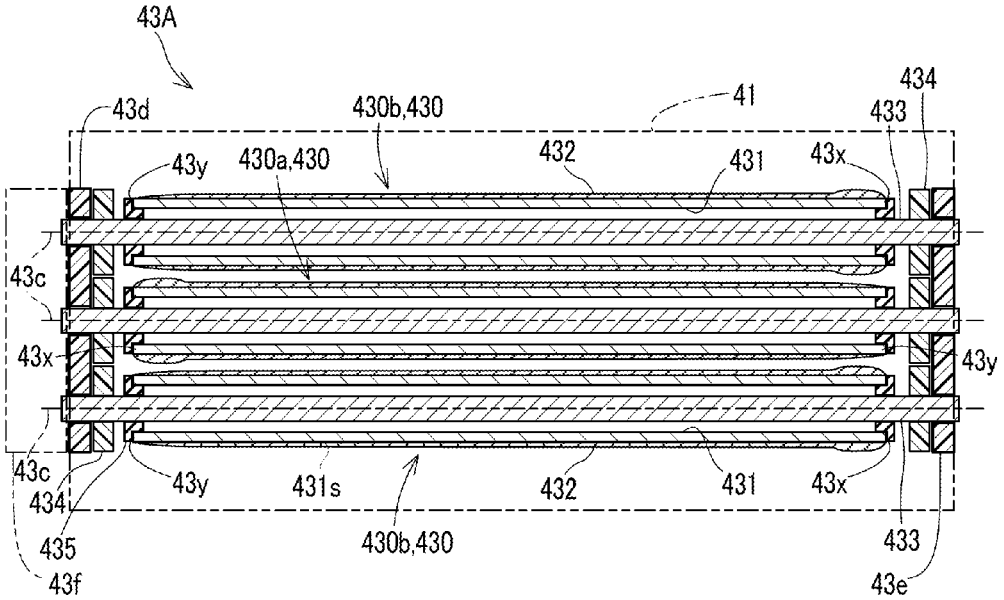
FIG. 6 is a cross-sectional view of a plurality of developing rollers supported by support portions of the developing device according to the second embodiment of the present disclosure.

Next, a description is given of a developing device 43A according to the second embodiment of the present disclosure with reference to FIG. 6. FIG. 6 is a cross-sectional view of a plurality of developing rollers supported by the support portions 43*d* and 43*e* of the developing device 43A.

In FIG. 6, the same components as those shown in FIGS. 1-5 are assigned the same reference signs. It is noted that in FIG. 6, the photoconductor 41 and the rotation driving portion 43*f* are drawn by an imaginary line (two-dot chain line). The following describes the difference of the developing device 43A from the developing device 43.

The developing device 43A includes an odd number of three or more developing rollers 430. In the example shown in FIG. 6, the developing device 43A includes three developing rollers 430. The odd number of developing rollers 430 are arranged from the upstream side to the downstream side in the rotation direction of the photoconductor drum 41 in such a manner that the directions faced by the first end 43*x* and the second end 43*y* are alternately reversed.

In addition, the second developing rollers 430*b* connected to the rotation driving portion 43*f* on the second end 43*y* side are one more than the first developing roller 430*a* connected to the rotation driving portion 43*f* on the first end 43*x* side.

In the developing device 43A, the thickness distribution of the developing coating layer 432 of one second developing roller 430*b* is not cancelled by another first developing roller 430*a*. However, when three or more developing rollers 430 are present, the influence, on the developing density, of the thickness distribution of the developing coating layer 432 of the one second developing roller 430*b* is very small.

As a result, with the adoption of the developing device 43A, the same effect is obtained as with the adoption of the developing device 43.

In addition, a test was conducted to evaluate the flowing amount of the toner 91 under eight conditions that differ only in the direction of the three developing rollers 430. According to the test, the least amount of the toner 91 flew under a first condition among the eight conditions. The first condition was that the three developing rollers 430 were arranged in such a manner that the directions faced thereby were alternately reversed, and the second developing rollers 430*b* were one more than the first developing roller 430*a*.

According to the test, the second least amount of the toner 91 flew under a second condition among the eight conditions. The second condition was that the three developing rollers 430 were arranged in such a manner that the directions faced thereby were alternately reversed, and the first developing rollers 430*a* were one more than the second developing roller 430*b*.

In addition, according to the test, a larger amount of the toner 91 flew under the other conditions in which the three developing rollers 430 were not arranged in such a manner that the directions faced thereby were alternately reversed, than under the first condition and the second condition.

The reason why a less amount of the toner 91 flew under the first condition than under the second condition is considered as follows. In general, the drive-side support portion 43*d* and the non-drive-side support portion 43*e* have equal play with the developing rollers 430. However, a part of the developing roller 430 on the drive-side support portion 43*d* side is connected to the rotation driving portion 43*f*, and thus at the part, the wobbling due to rotation is restricted more than at a part of the developing roller 430 on the non-drive-side support portion 43*e* side.

As a result, in the second developing roller 430*b*, a part on the second end 43*y* side that is relatively separated from the photoconductor drum 41 is connected to the rotation driving portion 43*f*, and at the part, the wobbling due to rotation is restricted more than at a part opposite to the part.

On the other hand, in the first developing rollers 430*a*, a part on the second end 43*y* side that is relatively separated from the photoconductor drum 41 has a larger wobbling due to rotation than at a part opposite to the part. As a result, the second developing rollers 430*b* are more difficult to have a wide gap with the photoconductor drum 41 due to the wobbling during rotation, than the first developing rollers 430*a*.

Under the first condition, a more number of second developing rollers 430*b* that are difficult to have a wide gap with the photoconductor drum 41, are provided than under the second condition. This is considered to be the reason why a less amount of the toner 91 flew under the first condition than under the second condition.

In the case where an odd number of developing rollers 430 are provided, the adoption of the developing device 43A can prevent the toner 91 from flying.

Application Examples

The developing devices 43, 43A may be applied to a monochrome image forming apparatus.

It is noted that the developing device and the image forming apparatus of the present disclosure may be configured by freely combining, within the scope of claims, the above-described embodiments and application examples, or by modifying the embodiments and application examples or omitting a part thereof.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developing device comprising:

a plurality of developing rollers rotatably supported in a state of being opposed to and not contacting an image-carrying member, and configured to supply toner to the image-carrying member, wherein each of the plurality of developing rollers includes:

a developing base body including a cylindrical outer circumferential surface; and a developing coating layer formed on a most outside of the outer circumferential surface of the developing base body, the developing coating layer has been formed by a dipping method in which the developing base body is dipped in a liquid in a state where the developing base body is in a vertical attitude such that a first end of the developing base body faces down and a second end of the developing base body faces up, and the plurality of developing rollers are arranged from an upstream side to a downstream side in a rotation direction of the image-carrying member in such a manner that directions faced by the first end and the second end of each of the plurality of developing rollers are alternately reversed.

2. The developing device according to claim 1, wherein the developing coating layer includes a layer of alcohol-soluble nylon and conductive powder that is distributed in the layer of alcohol-soluble nylon.

3. The developing device according to claim 2, wherein the conductive powder is titanium oxide powder.

4. The developing device according to claim 1, wherein the plurality of developing rollers are an odd number of developing rollers, the odd number of developing rollers include:

first developing rollers connected to a rotation driving portion on a first end side; and second developing rollers connected to the rotation driving portion on a second end side and are one more than the first developing rollers.

5. The developing device according to claim 1 further comprising a two-component developer carrying member configured to carry two-component developer which includes the toner and particles of carrier having magnetism, and supply the toner to the plurality of developing rollers.

6. An image forming apparatus comprising:

an image-carrying member configured to carry a toner image; and the developing device according to claim 1.

* * * * *